US010918176B1

(12) United States Patent
Roth

(10) Patent No.: US 10,918,176 B1
(45) Date of Patent: Feb. 16, 2021

(54) MAGNETIC BACKING FOR COLLECTOR PIN

(71) Applicant: Michael Roth, Lebanon, PA (US)

(72) Inventor: Michael Roth, Lebanon, PA (US)

( * ) Notice: Subject to any disclaimer, the term of this patent is extended or adjusted under 35 U.S.C. 154(b) by 0 days.

(21) Appl. No.: 16/595,596

(22) Filed: Oct. 8, 2019

(51) Int. Cl.
*A44C 25/00* (2006.01)

(52) U.S. Cl.
CPC ..... *A44C 25/00* (2013.01); *A44D 2203/00* (2013.01)

(58) Field of Classification Search
CPC ..... A44D 2203/00; Y10T 24/32; A44C 25/00
See application file for complete search history.

(56) References Cited

U.S. PATENT DOCUMENTS 2,659,169 A 11/1953 Brennan
3,111,737 A * 11/1963 Heil ..... A41F 1/002 24/303
4,005,507 A * 2/1977 Yamazaki ..... B43M 15/00 24/351
D282,354 S 1/1986 Merrels
5,732,451 A 3/1998 Mars
5,806,346 A 9/1998 Schlinger
6,748,602 B1 6/2004 Barnes
7,866,076 B2 * 1/2011 Roche ..... B32B 3/06 40/661.01
8,052,365 B2 * 11/2011 Aller ..... B43M 15/00 411/439
8,375,615 B2 * 2/2013 Cameron ..... B43M 15/00 24/546
8,631,517 B1 * 1/2014 Blakely ..... A44B 1/28 2/266
8,793,846 B2 8/2014 D'Auriac
9,132,054 B2 9/2015 Rojdev
9,795,193 B2 * 10/2017 Fujita ..... A44B 17/0052
10,136,704 B2 * 11/2018 Garnighian ..... A44B 1/28
10,595,619 B2 * 3/2020 Cureington ..... A45C 13/001
2007/0186390 A1 * 8/2007 Johnston ..... A44C 3/001 24/303
2008/0005873 A1 * 1/2008 Barton ..... B43M 15/00 24/303
2010/0000057 A1 * 1/2010 Wang ..... B43M 15/00 24/356
2014/0182114 A1 * 7/2014 Stokes ..... F16B 5/0692 29/525.03
2015/0273933 A1 * 10/2015 Meninga ..... A44C 1/00 428/28
2017/0238684 A1 * 8/2017 Cureington ..... A45C 13/001
2019/0320765 A1 * 10/2019 Sullivan ..... A44B 9/18

FOREIGN PATENT DOCUMENTS

WO 1998042225 10/1998

* cited by examiner

*Primary Examiner* — Robert Sandy
*Assistant Examiner* — Louis A Mercado

(57) ABSTRACT

The magnetic backing for collector pins is a mounting structure. The magnetic backing for collector pins is a magnetic structure. The magnetic backing for collector pins magnetically attaches to a target surface. The target surface is formed from a material that includes a magnetic material. The magnetic backing for collector pins is configured for use with a collector pin. The collector pin is a jewelry item that attaches to a garment. The collector pin attaches to the magnetic backing for collector pins such that the collector pin is displayed from the target surface. The magnetic backing for collector pins includes a truncated pyramid structure and a magnet. The magnet attaches to the truncated pyramid structure.

9 Claims, 3 Drawing Sheets

MAGNETIC BACKING FOR COLLECTOR PIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities including jewelry, more specifically, an accessory for brooches and breast-pins. (A44B9/16)

SUMMARY OF INVENTION

The magnetic backing for collector pins is a mounting structure. The magnetic backing for collector pins is a magnetic structure. The magnetic backing for collector pins magnetically attaches to a target surface. The target surface is formed from a material that comprises a magnetic material. The magnetic backing for collector pins is configured for use with a collector pin. The collector pin is a jewelry item that attaches to a garment. The collector pin comprises a display plate and an attachment pin. The attachment pin attaches to the display plate. The display plate is a disk-shaped decorative item. The attachment pin is a sharpened shaft that attaches the display plate to the garment. The collector pin attaches to the magnetic backing for collector pins such that the collector pin is displayed from the target surface. The magnetic backing for collector pins comprises a truncated pyramid structure and a magnet. The magnet attaches to the truncated pyramid structure.

These together with additional objects, features and advantages of the magnetic backing for collector pins will be readily apparent to those of ordinary skill in the art upon reading the following detailed description of the presently preferred, but nonetheless illustrative, embodiments when taken in conjunction with the accompanying drawings.

In this respect, before explaining the current embodiments of the magnetic backing for collector pins in detail, it is to be understood that the magnetic backing for collector pins is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the magnetic backing for collector pins.

It is therefore important that the claims be regarded as including such equivalent construction insofar as they do not depart from the spirit and scope of the magnetic backing for collector pins. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
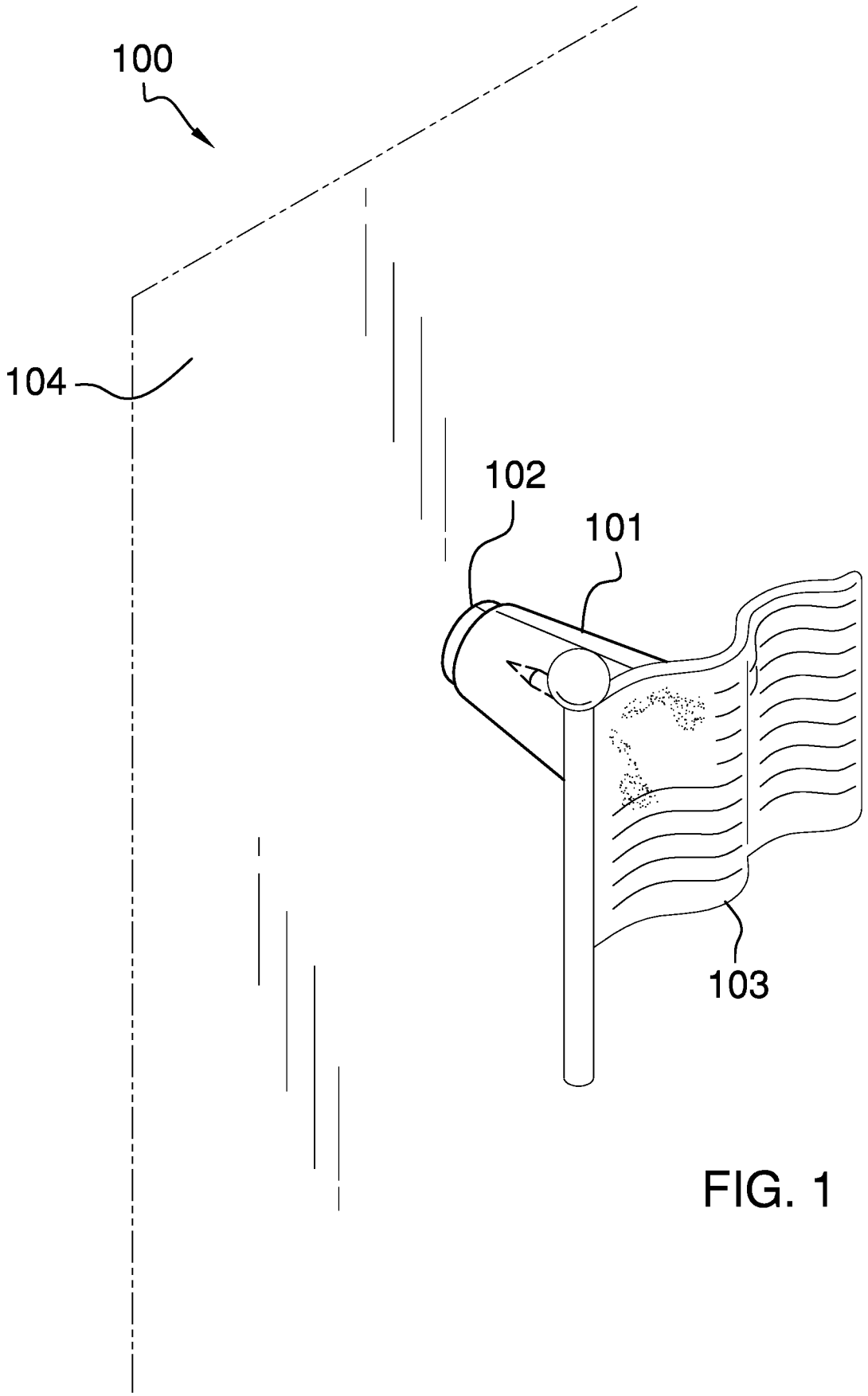
FIG. 1 is a perspective view of an embodiment of the disclosure.
Figure 2:
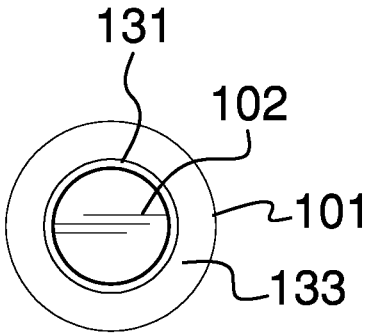
FIG. 2 is a bottom view of an embodiment of the disclosure.
Figure 3:
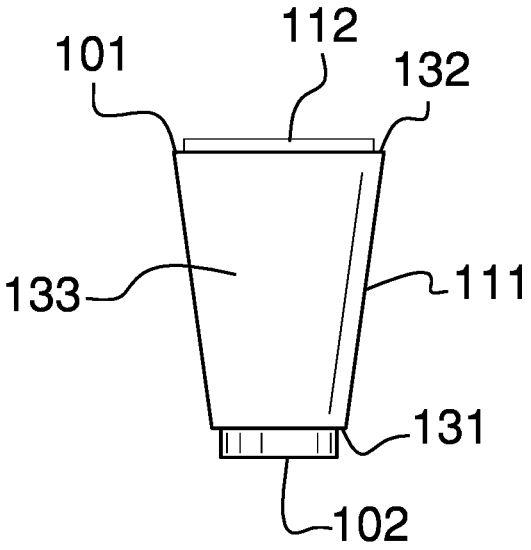
FIG. 3 is a side view of an embodiment of the disclosure.
Figure 4:
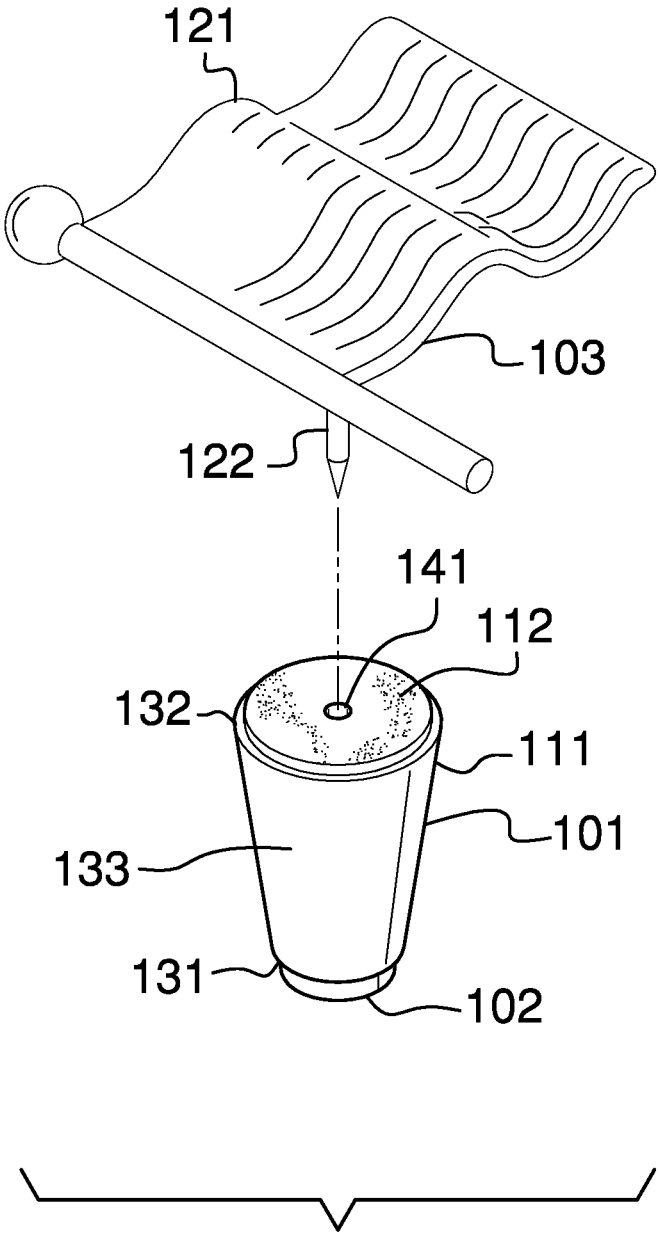
FIG. 4 is an exploded view of an embodiment of the disclosure.
Figure 5:
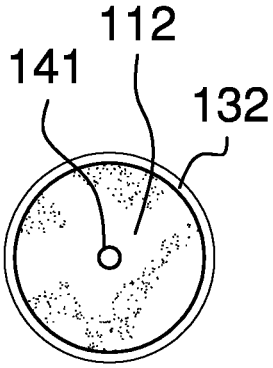
FIG. 5 is a top view of an embodiment of the disclosure.

Detailed reference will now be made to one or more potential embodiments of the disclosure, which are illustrated in FIGS. 1 through 5.

The magnetic backing for collector pins 100 (hereinafter invention) is a mounting structure. The invention 100 is a magnetic structure. The invention 100 magnetically attaches to a target surface 104. The target surface 104 is formed from a material that comprises a magnetic material. The invention 100 is configured for use with a collector pin 103. The collector pin 103 is a jewelry item that attaches to a garment. The collector pin 103 comprises a display plate 121 and an attachment pin 122. The attachment pin 122 attaches to the display plate 121. The display plate 121 is a disk-shaped decorative item. The attachment pin 122 is a sharpened shaft that attaches the display plate 121 to the garment. The collector pin 103 attaches to the invention 100 such that the collector pin 103 is displayed from the target surface 104. The invention 100 comprises a truncated pyramid structure 101 and a magnet 102. The magnet 102 attaches to the truncated pyramid structure 101.

The truncated pyramid structure 101 is a mechanical structure. The truncated pyramid structure 101 has the shape of a truncated pyramid. The attachment pin 122 of the collector pin 103 inserts into the truncated pyramid structure 101 such that the collector pin 103 attaches to the truncated pyramid structure 101. The truncated pyramid structure 101 comprises a shell 111 and a cork filling 112.

The shell 111 is a rigid structure. The shell 111 is a hollow structure. The shell 111 has the shape of a truncated pyramid. The shell 111 contains the cork filling 112. The shell 111 comprises a truncated apex 131, a base 132, and one or more lateral faces 133.

The truncated apex 131 is a solid surface. The truncated apex 131 is the surface formed by the truncating plane that truncates the apex of the core pyramid that forms the truncated pyramid shape of the shell 111. The truncated apex 131 is perpendicular to the center axis of the truncated pyramid shape that forms the truncated pyramid structure 101.

The base 132 is the structure that forms the base 132 of the truncated pyramid shape of the shell 111. The base 132 is an open surface such that access to the interior of the shell 111 is accessible through the base 132.

The one or more lateral faces 133 are solid surfaces. The one or more lateral faces 133 form the lateral faces of the truncated pyramid shape that forms the shell 111.

The cork filling 112 is a semi-rigid material that fills the negative space formed by the hollow interior of the shell 111. The cork filling 112 is made for a cork material. Cork is defined elsewhere in this disclosure. The cork filling 112 is accessible from the exterior of the shell 111 through the base of the truncated pyramid shape of the shell 111. The collector pin 103 attaches to the truncated pyramid structure 101 by inserting the attachment pin 122 of the collector pin 103 into the cork filling 112. The cork filling 112 further comprises a pin hole 141.

The pin hole 141 is a prism-shaped cavity that is formed into the cork filling 112. The pin hole 141 is accessible from the exterior of the shell 111 through the base 132 of the shell 111. The pin hole 141 is formed in the cork filling 112 such that the center axis of prism shape of the pin hole 141 aligns with the center axis of the cork filling 112.

The magnet 102 is a disk-shaped structure. The magnet 102 is formed as a magnet 102. The magnet 102 attaches to the exterior surface of the truncated apex 131 of the truncated pyramid shape that forms the truncated pyramid structure 101. The magnet 102 attaches the truncated pyramid structure 101 to the target surface 104 such that the center axis of the shell 111 projects perpendicularly away from the target surface 104. The magnet 102 attaches to the truncated apex 131 such that the center axis of the disk structure that forms the magnet 102 aligns with the center axis of the shell 111 of the truncated pyramid structure 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Apex: As used in this disclosure, an apex is a vertex that forms an extreme or solitary point of an object.

Cavity: As used in this disclosure, a cavity is an empty space or negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cork: As used in this disclosure, cork refers to a semi-rigid structure with that: a) floats in water; and, b) is water impermeable. Cork products can be either natural or manufactured. Most cork products are intended to be pierced by sharpened tips from tools such as corkscrews and thumbtacks.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Form Factor: As used in this disclosure, the term form factor refers to the size and shape of an object.

Garment: As used in this disclosure, a garment is a textile-based structure that is used to cover an individual. Clothes, clothing, and apparel are synonyms for garment.

Jewelry: As used in this disclosure, jewelry is a personal decorative item that is worn by a person. Examples of jewelry include, but are not limited to, necklaces, bracelets, rings, earrings, cufflinks, brooches, and wristwatches.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field.

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism.

The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shell: As used in this disclosure, a shell is a structure that forms an outer covering intended to contain an object. Shells are often, but not necessarily, rigid or semi-rigid structures that are intended to protect the object contained within it.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Vertex: As used in this disclosure, a vertex (plural vertices) is an angle that is formed by two lines (or a plurality of surfaces) that form a point. Vertices are commonly found in polygons, prisms, and pyramids.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A magnetic backing for collector pins comprising
- a truncated pyramid structure and a magnet;
- wherein the magnet attaches to the truncated pyramid structure;
- wherein the magnetic backing for collector pins is a mounting structure;
- wherein the magnetic backing for collector pins is a magnetic structure;
- wherein the magnetic backing for collector pins magnetically attaches to a target surface;
- wherein the target surface is formed from a material that comprises a magnetic material;
- wherein the magnetic backing for collector pins is configured for use with a collector pin;
- wherein the truncated pyramid structure comprises a shell and a cork filling;
- wherein the shell contains the cork filling;
- wherein a collector pin comprises a display plate and an attachment pin;
- wherein the attachment pin attaches to the display plate;
- wherein the display plate is disk-shaped;
- wherein the attachment pin is a sharpened shaft that attaches the display plate to the target surface;
- wherein the collector pin attaches to the magnetic backing for collector pins such that the collector pin is displayed from the target surface when the magnetic backing for collector pins attaches to the target surface;
- wherein the truncated pyramid structure is a mechanical structure;
- wherein the truncated pyramid structure has a truncated pyramid shape;
- wherein the attachment pin of the collector pin inserts into the truncated pyramid structure such that the collector pin attaches to the truncated pyramid structure;
- wherein the shell is a rigid structure;
- wherein the shell is a hollow structure;
- wherein the shell has a truncated pyramid shape;
- wherein the shell comprises a truncated apex, a base, and one or more lateral faces;
- wherein the truncated apex is a surface formed by a truncating plane that truncates the apex of a core pyramid that forms the truncated pyramid shape of the shell;
- wherein the base is the rigid structure that forms the base of the truncated pyramid shape of the shell;
- wherein the one or more lateral faces form the lateral faces of the truncated pyramid shape that forms the shell;
- wherein the truncated apex is perpendicular to a center axis of the truncated pyramid shape that forms the truncated pyramid structure;
- wherein the truncated apex is a solid surface;
- wherein the base is an open surface;
- wherein the one or more lateral faces are solid surfaces;
- wherein the cork filling, is a semi-rigid material that fills a negative space formed by a hollow interior of the shell;
- wherein the cork filling is accessible from an exterior of the shell through the base of the truncated pyramid shape of the shell.

2. The magnetic backing for collector pins according to claim 1 wherein the collector pin attaches to the truncated pyramid structure by inserting the attachment pin of the collector pin into the cork filling.

3. The magnetic backing for collector pins according to claim 2 wherein the cork filling further comprises a pin hole;

wherein the pin hole is a prism-shaped cavity that is formed into the cork filling.

4. The magnetic backing for collector pins according to claim 3 wherein the pin hole is accessible from the exterior of the shell through the base of the shell.

5. The magnetic backing for collector pins according to claim 4 wherein the pin hole is formed in the cork filling such that a center axis of the prism-shaped cavity of the pin hole aligns with a center axis of the cork filling.

6. The magnetic backing for collector pins according to claim 5 wherein the magnet is a disk-shaped structure.

7. The magnetic backing for collector pins according to claim 6 wherein the magnet attaches to an exterior surface of the truncated apex of the truncated pyramid shape that forms the truncated pyramid structure.

8. The magnetic backing for collector pins according to claim 7 wherein the magnet attaches the truncated pyramid structure to the target surface such that a center axis of the shell projects perpendicularly away from the target surface.

9. The magnetic backing for collector pins according to claim 8 wherein the magnet attaches to the truncated apex such that a center axis of the disk-shaped structure that forms the magnet aligns with the center axis of the shell of the truncated pyramid structure.

* * * * *